US009494103B2

(12) United States Patent
Miwa et al.

(10) Patent No.: US 9,494,103 B2
(45) Date of Patent: Nov. 15, 2016

(54) CYLINDER BLOCK MANUFACTURING METHOD AND CYLINDER BLOCK

(71) Applicant: NISSAN MOTOR CO., LTD., Yokohama-shi, Kanagawa (JP)

(72) Inventors: Hirotaka Miwa, Yokohama (JP); Takafumi Watanabe, Chigasaki (JP); Kiyokazu Sugiyama, Chigasaki (JP); Mitsuo Hayashi, Kawasaki (JP); Daisuke Terada, Yokohama (JP); Yoshitsugu Noshi, Kawasaki (JP); Eiji Shiotani, Kawasaki (JP); Yoshiaki Miyamoto, Yokohama (JP); Kazuaki Taniguchi, Isehara (JP)

(73) Assignee: NISSAN MOTOR CO., LTD., Yokohama-Shi (JP)

( * ) Notice: Subject to any disclaimer, the term of this patent is extended or adjusted under 35 U.S.C. 154(b) by 145 days.

(21) Appl. No.: 14/366,506

(22) PCT Filed: Nov. 5, 2012

(86) PCT No.: PCT/JP2012/078624

§ 371 (c)(1),
(2) Date: Jun. 18, 2014

(87) PCT Pub. No.: WO2013/094324

PCT Pub. Date: Jun. 27, 2013

(65) Prior Publication Data

US 2015/0300288 A1 Oct. 22, 2015

(30) Foreign Application Priority Data

Dec. 22, 2011 (JP) ..... 2011-281331

(51) Int. Cl.
*F02F 1/00* (2006.01)
*C23C 4/18* (2006.01)
(Continued)

(52) U.S. Cl.
CPC ..... *F02F 1/004* (2013.01); *C23C 4/02* (2013.01); *C23C 4/18* (2013.01); *F02F 1/00* (2013.01);
(Continued)

(58) Field of Classification Search
CPC ..... Y10T 29/49231; Y10T 29/4927; Y10T 29/49272; Y10T 29/49885; Y10T 29/4998; Y10T 29/49984; Y10T 29/49988; F02F 1/004; F02F 1/18; F02F 1/00; F02F 2200/06; F02F 7/0012; C23C 4/18; C23C 4/02
See application file for complete search history.

(56) References Cited

U.S. PATENT DOCUMENTS 5,271,967 A * 12/1993 Kramer ..... C23C 4/12 29/888.061
5,691,004 A * 11/1997 Palazzolo ..... C23C 4/02 427/236

(Continued)

FOREIGN PATENT DOCUMENTS

CN 101033533 A 9/2007
CN 101939462 A 1/2011

(Continued)

OTHER PUBLICATIONS

U.S. Appl. No. 14/359,829, filed May 21, 2014, Tanguchi et al.

(Continued)

*Primary Examiner* — David Bryant
*Assistant Examiner* — Lawrence Averick
(74) *Attorney, Agent, or Firm* — Foley & Lardner LLP

(57) ABSTRACT

A cylinder block manufacturing method including: machining an inner surface of a cylinder bore (3) of a cylinder block (1) into a first shape different from a target shape before a bearing cap (7) is attached to the cylinder block (1) so that the inner surface of the cylinder bore (3) is deformed into the target shape by attachment of the bearing cap (7) to the cylinder block (1); and forming a thermal spray coating (5) on the inner surface of the cylinder bore (3) having the first shape.

3 Claims, 5 Drawing Sheets

(51) Int. Cl.
*C23C 4/02* (2006.01)
*F02F 1/18* (2006.01)
*F02F 7/00* (2006.01)

(52) U.S. Cl.
CPC ..... *F02F 1/18* (2013.01); *F02F 7/0095* (2013.01); *F02F 7/0053* (2013.01); *F02F 2200/06* (2013.01); *F05C 2253/12* (2013.01)

(56) References Cited

U.S. PATENT DOCUMENTS 5,714,205 A * 2/1998 Marantz ..... B05B 7/0861 219/76.14
5,723,187 A * 3/1998 Popoola ..... C23C 4/02 427/310
7,089,622 B2 * 8/2006 Sampaio ..... A47L 13/142 15/120.1
7,823,284 B2 * 11/2010 Takahashi ..... B05B 15/0431 118/306
7,851,046 B2 * 12/2010 Nishimura ..... C23C 4/02 29/888.061
8,286,468 B2 10/2012 Nishimura et al.
8,534,256 B2 * 9/2013 Whitbeck ..... B23B 27/24 123/193.2
2003/0120374 A1 6/2003 Klink et al.
2005/0054270 A1 3/2005 Klink et al.
2005/0235944 A1 * 10/2005 Michioka ..... C23C 4/02 123/193.2
2006/0026828 A1 * 2/2006 Boehm ..... B24C 1/06 29/888.061
2007/0212519 A1 9/2007 Nishimura et al.
2010/0316798 A1 12/2010 Takahashi et al.
2011/0023777 A1 2/2011 Nishimura et al.

FOREIGN PATENT DOCUMENTS

DE 10 2007 023297 A1 2/2008
JP 2000-291487 A 10/2000
JP 2006-291336 A 10/2006
JP 2007-277608 A 10/2007
JP 2008-232734 A 10/2008
JP 2009-197309 A 9/2009
JP 2009-228130 A 10/2009
JP 2010-209454 A 9/2010

OTHER PUBLICATIONS

U.S. Appl. No. 14/367,590, filed Jun. 20, 2014, Hayashi et al.

* cited by examiner (a)

(b)

CYLINDER BLOCK MANUFACTURING METHOD AND CYLINDER BLOCK

TECHNICAL FIELD

The present invention relates to a cylinder block manufacturing method in which a thermal spray coating is formed on an inner surface of a cylinder bore, and also relates to a cylinder block.

BACKGROUND ART

Due to requests for improvement in output, fuel consumption, and exhaust performance of an internal-combustion engine or for size or weight reduction thereof, there are considerably high demands for designs that exclude the use of a cylinder liner on each cylinder bore of an aluminum cylinder block. Alternative techniques include forming a thermal spray coating made of an iron-based material on an inner surface of each cylinder bore of a cylinder block made of an aluminum alloy (see Patent Literature 1).

CITATION LIST

Patent Literature

Patent Literature 1: Japanese Patent Application Publication No. 2006-291336

SUMMARY OF INVENTION

Technical Problem

When a fastener such as a bolt is used to attach a bearing cap to the cylinder block having a thermal spray coating formed on an inner surface of each cylinder bore, the cylinder bore is deformed by a stress generated when the fastener is fastened. The inner surface of the deformed cylinder bore has poor cylindricity and does not form a true cylindrical shape (a cylindrical shape satisfying required cylindricity). To be more specific, the shape of the inner surface of the cylinder bore in a section perpendicular to an axial direction of the cylinder bore is not a true circle (a circle satisfying required roundness), but an ellipse or an oval.

For the reason above, if a finishing process such as honing is performed on the thermal spray coating formed on the inner surface of the cylinder bore after the bearing cap is attached to the cylinder block, the shape of the inner surface of the cylinder bore needs to be corrected into a true cylindrical shape during the finishing process. For this reason, work performance in the finishing process is lowered.

An objective of the present invention is to improve work performance in a finishing process performed on a thermal spray coating on an inner surface of a cylinder bore after a bearing cap is attached to a cylinder block.

Solution to Problem

A first aspect of the present invention is a cylinder block manufacturing method including: machining an inner surface of a cylinder bore of a cylinder block into a first shape different from a target shape before a bearing cap is attached to the cylinder block so that the inner surface of the cylinder bore is deformed into the target shape by attachment of the bearing cap to the cylinder block; and forming a thermal spray coating on the inner surface of the cylinder bore having the first shape.

A second aspect of the present invention is a cylinder block including: a cylinder bore whose inner surface is machined into a first shape different from a target shape; and a thermal spray coating formed on the inner surface of the cylinder bore having the first shape.

BRIEF DESCRIPTION OF DRAWINGS

FIG. 2(*a*) is a view seen in arrow A in FIG. 1, and FIG. 2(*a*) is a view seen in arrow 13 in FIG. 1.

FIG. 7(*a*) is a view seen in arrow A in FIG. 6, and FIG. 7(*b*) is a view seen in arrow 13 in FIG. 6.

FIG. 8(*a*) shows rough honing, and FIG. 8(*h*) shows finish honing.

DESCRIPTION OF EMBODIMENTS

Embodiments of the present invention are described below based on the drawings.

First Embodiment

Figure 1:
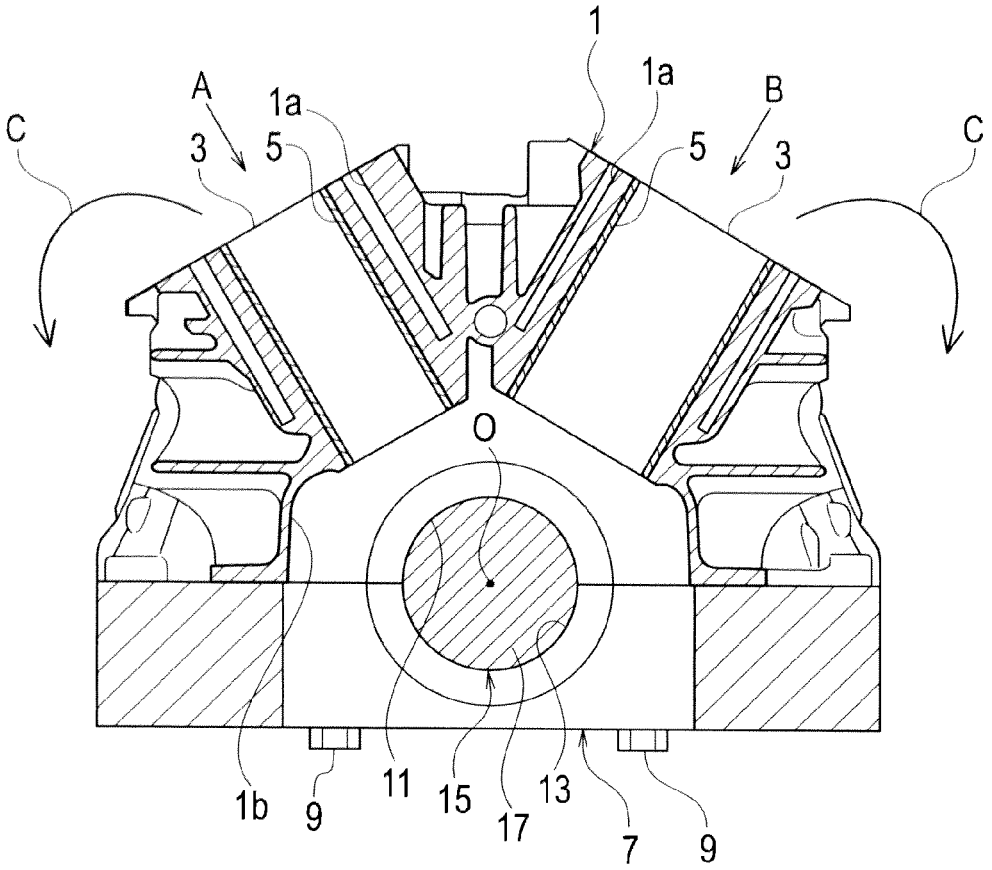
FIG. 1 is a sectional view showing a state where a bearing cap is attached to a cylinder block according to a first embodiment of the present invention.

A cylinder block 1 of a V-engine for automobile shown in FIG. 1 is made of an aluminum alloy and has a thermal spray coating 5 formed on an inner surface of each cylinder bore 3 to improve performance such as resistance to wear. The thermal spray coating 5 is formed by a conventionally-known method. For example, a thermal spraying gun (not shown) is inserted into each cylinder bore 3 and caused to reciprocate in an axial direction of the cylinder bore 3 while being rotated. Meanwhile, droplets are injected from a nozzle portion provided at a tip end of the thermal spraying gun and are attached to an inner surface of the cylinder bore 3. A wire which is made of an iron-based material and is a thermal spray material is sequentially supplied to the nozzle portion from the outside of the thermal spraying gun, and the droplets are generated by melting this wire by use of a heat source such as a plasma arc.

A bearing cap 7 is fastened and fixed to a lower surface of the cylinder block 1 by multiple bolts 9 as fasteners. The bearing cap 7 supports a crankshaft 15 between itself and the cylinder block 1. A journal portion 17 of the crankshaft 15 is rotatably supported by a bearing portion 13 of the bearing cap 7 and a bearing portion 11 of the cylinder block 1.

An oil pan (not shown) is attached to a lower surface of the bearing cap 7 which is opposite from the cylinder block 1, and a cylinder head (not shown) is attached to an upper surface of the cylinder block 1 which is opposite from the bearing cap 7.

Figure 3:
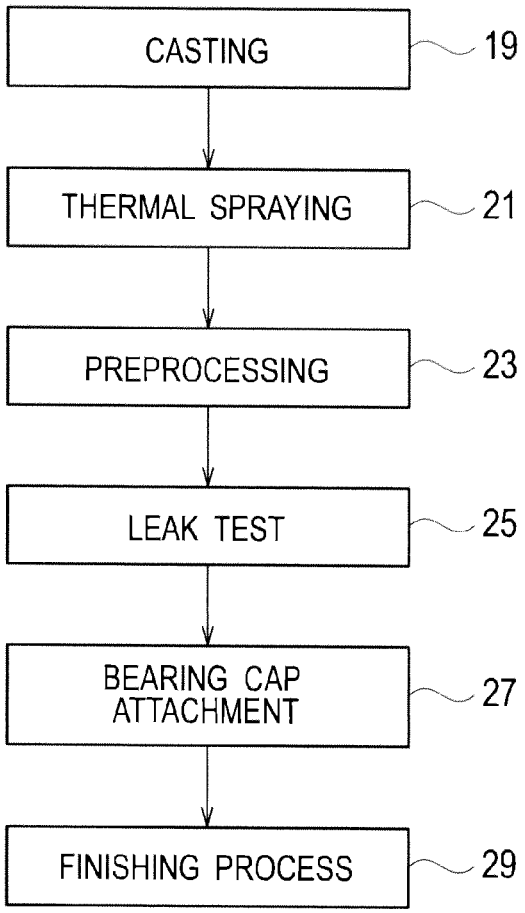
FIG. 3 is a flowchart showing a cylinder block manufacturing method according to the first embodiment.

FIG. 3 is a flowchart showing a cylinder block manufacturing method according to the first embodiment. After the cylinder block 1 is casted in a casting step 19, the thermal spray coating 5 is formed on the inner surface of each cylinder bore 3 in a thermal spraying step 21. After the thermal spraying step 21, the outer shape of the cylinder block 1 is machined in a preprocessing step 23, and then a leak test 25 is performed.

The leak test 25 is a liquid leak test for checking leak of a coolant inside a water jacket 1*a* and leak of a lubricant inside a crankcase 1*b*. This leak test 25 is performed by a conventionally-known method. For example, the internal pressure of the water jacket 1*a* or the crankcase 1*b* is increased under airtight conditions. Then, it is determined whether or not the internal pressure is maintained at or above a prescribed value after a lapse of a predetermined period of time.

After the leak test 25, the flow proceeds to a bearing cap attachment step 27 in which the bearing cap 7 is fastened and fixed to the cylinder block 1 with the multiple bolts 9. The flow then proceeds to a finishing process step 29 in which a finishing process, such as honing, is performed on the thermal spray coating 5 formed on the inner surface of each cylinder bore 3.

Figure 2:
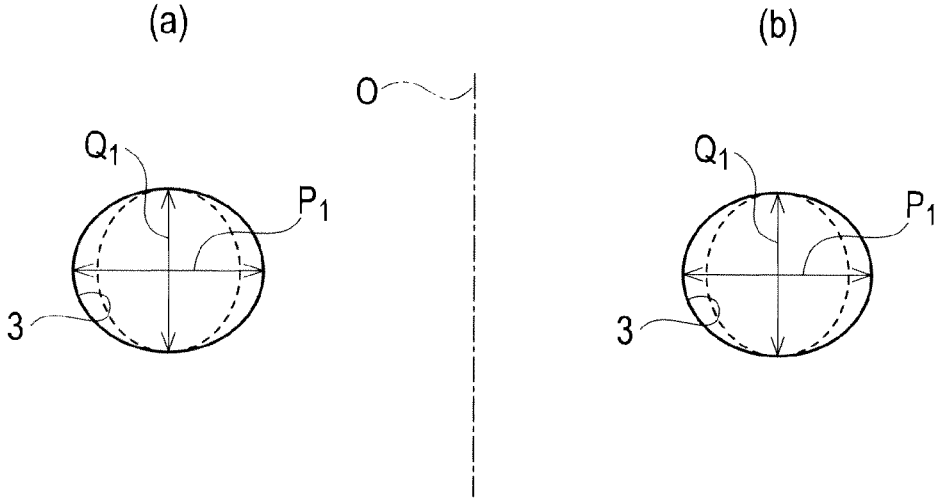
FIG. 2 is an explanatory diagram showing how a cylinder bore is deformed by attachment of the bearing cap to the cylinder block.

In the bearing cap attachment step 27, the cylinder bore 3 is deformed by a stress generated when the multiple bolts 9 are fastened. Supposing that the inner surface of the cylinder bore 3 has a regular cylindrical shape before the bearing cap 7 is attached to the cylinder block 1, the deformation of the cylinder bore 3 caused by the fastening of the bolts 9 degrades the cylindricity of the inner surface of the cylinder bore 3. In other words, even if the inner surface of the cylinder bore 3 has a true cylindrical shape (a cylindrical shape satisfying required cylindricity) before the attachment of the bearing cap 7, the inner surface of the cylinder bore 3 no longer has a true cylindrical shape after the attachment of the bearing cap 7. To be more specific, the shape of the inner surface of each cylinder bore 3 in a section perpendicular to the axial direction of the cylinder bore 3 is not a true circle (a circle satisfying required roundness) shown in FIG. 2 with a broken line in FIG. 2, but an ellipse or an oval. For example, as shown in FIGS. 2(*a*) and 2(*b*) with a solid line, each cylinder bore 3 is deformed into an ellipse or oval whose length (a longer diameter after deformation) $P_1$ measured in a direction corresponding to a left and right direction in FIG. 1 is larger than a length (a shorter diameter after deformation) $Q_1$ measured in a direction corresponding to a direction orthogonal to the paper plane of FIG. 1. Note that the direction orthogonal to the paper plane of FIG. 1 is a direction parallel to a rotation axis O of the crankshaft 15, and the left and right direction in FIG. 1 is a direction parallel to the plane which is orthogonal to the rotation axis O of the crankshaft 15.

The deformations of the cylinder bores 3 described above are caused when peripheral portions of the left and right cylinder bores 3 are deformed by slanting to the left and to the right (in directions indicated by arrows C in FIG. 1), respectively, by the fastening of the bolts 9 located on the left and right sides of a center between the left and right cylinder bores 3 in FIG. 1. The slanting deformations occur from the center between the left and right cylinder bores 3. It can also be said that the deformations of the cylinder bores 3 described above are caused when the peripheral portions of the cylinder bores 3 in parallel with each other with the rotation axis O of the crankshaft 15 therebetween rotate about the rotation axis O in directions away from each other by the fastening of the bolts 9 located at both sides of the rotation axis O of the crankshaft 15.

For the honing performed in the finishing process step 29 on the thermal spray coating 5 on the inner surface of each cylinder bore 3 whose cylindricity is degraded, the inner surface of the cylinder bore 3 has to have a thickness which can undergo a large amount of machining, the thickness being larger than that required if the cylindricity is not degraded. Specifically, a larger amount of machining has to be performed on regions corresponding to shorter-diameter portions of the ellipse or oval in the section perpendicular to the axial direction of the cylinder bore 3, than on regions corresponding to longer-diameter portions thereof. To absorb such an imbalance (unevenness) in the amount of machining, the thermal spray coating needs to be formed thickly over the entire inner surface of each cylinder bore 3, and consequently, more material is used to form the thermal spray coating.

Figure 4:
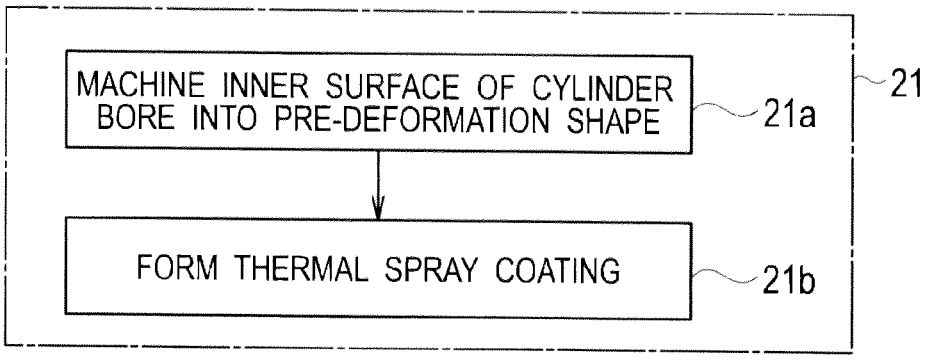
FIG. 4 is an explanatory diagram showing contents of work performed in a thermal spraying step in the flowchart of FIG. 3.

Thus, in this embodiment, works shown in FIG. 4 are performed in the thermal spraying step 21 shown in FIG. 3. Specifically, the inner surface of each cylinder bore 3 is machined into a pre-deformation shape (first shape) in advance (a work 21*a*) so that the inner surface of the cylinder bore 3 may be deformed into a true cylindrical shape (target shape) as a result of the deformation caused by the attachment of the bearing cap 7 to the cylinder block 1. The pre-deformation shape is a shape different from a target, true cylindrical shape, and is obtained by, for example, deforming the true cylindrical shape in directions opposite to directions in which the cylinder bore 3 is deformed by the attachment of the bearing cap 7 to the cylinder block 1. For example, if the deformation of the cylinder bore 3 caused by the attachment of the bearing cap 7 to the cylinder block 1 is elongation deformation along certain directions, the deformation in the opposite directions means contraction deformation along the same directions. More specifically, if the deformation caused by the attachment of the bearing cap 7 is deformation in which a section of the cylinder bore 3 perpendicular to the axial direction thereof is elongated in certain directions, the deformation in the opposite directions means deformation in which the section is contracted along the same directions. Alternatively, the deformation in the opposite directions can be understood as deformation in which the section is elongated in directions orthogonal to the directions of elongation caused by the attachment of the bearing cap 7.

Figure 6:
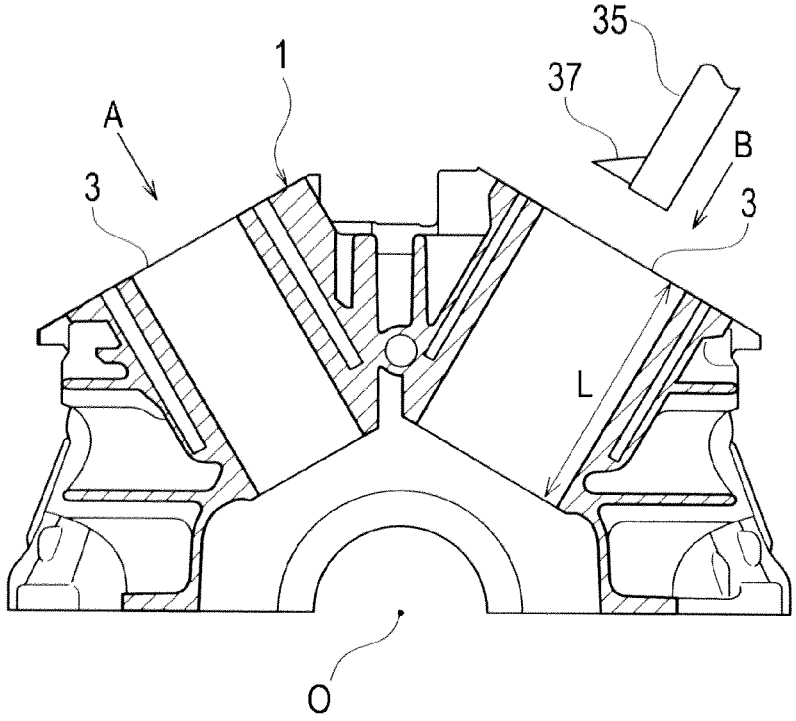
FIG. 6 is a sectional view showing an inner surface of the cylinder bore being machined to make it deformed relative to a true cylindrical shape, before attachment of the bearing cap to the cylinder block.

FIG. 6 shows a method of machining the inner surface of each cylinder bore 3 into the pre-deformation shape. For example, the machining is performed by rotating a boring bar 35 while inserting the boring bar 35 into the cylinder bore 3 and by moving a cutting blade 37 provided at a tip end of the boring bar 35 along the inner surface of the cylinder bore 3. The position of the cutting blade 37 can be continuously controlled by NC control.

Figure 7:
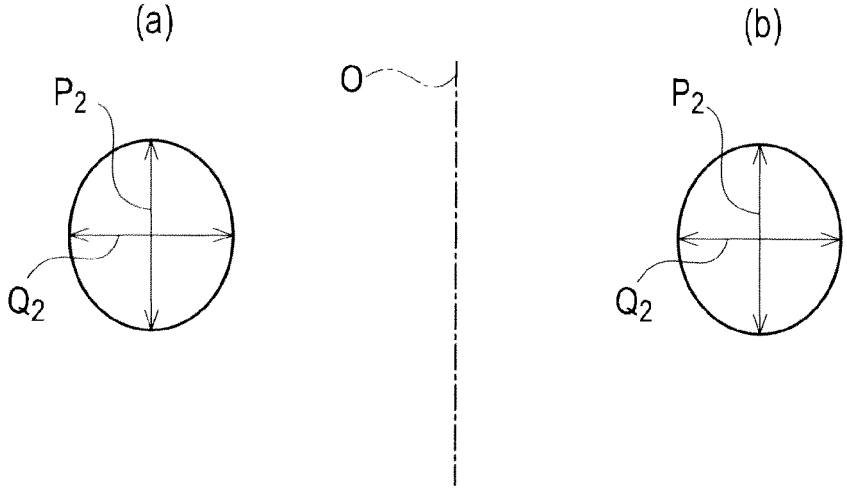
FIG. 7 shows the shapes of the machined cylinder bores.

By the machining performed in the work 21*a* in FIG. 4, the shape of the inner surface of the cylinder bore 3 in its section perpendicular to the axial direction of the cylinder bore 3 is formed into not a true circle, but an ellipse or oval, as shown in FIGS. 7(*a*) and 7(*b*). To be more specific, the inner surface of the cylinder bore 3 is formed into an ellipse or oval shape whose length (a longer diameter before deformation) $P_2$ measured in a direction corresponding to the direction orthogonal to the paper plane of FIG. 6 is larger than a length (a shorter diameter before the deformation) $Q_2$ measured in a direction corresponding to the left and right direction in FIG. 6. This ellipse or oval is a shape obtained by deforming a true circle in directions opposite to the directions in which the cylinder bore 3 is to be deformed by the attachment of the bearing cap 7 to the cylinder block 1. Note that the direction orthogonal to the paper plane of FIG. 6 is a direction parallel to the rotation axis O of the crankshaft 15, and the left and right direction in FIG. 6 is a direction parallel to the plane which is orthogonal to the rotation axis O of the crankshaft 15.

Figure 5:
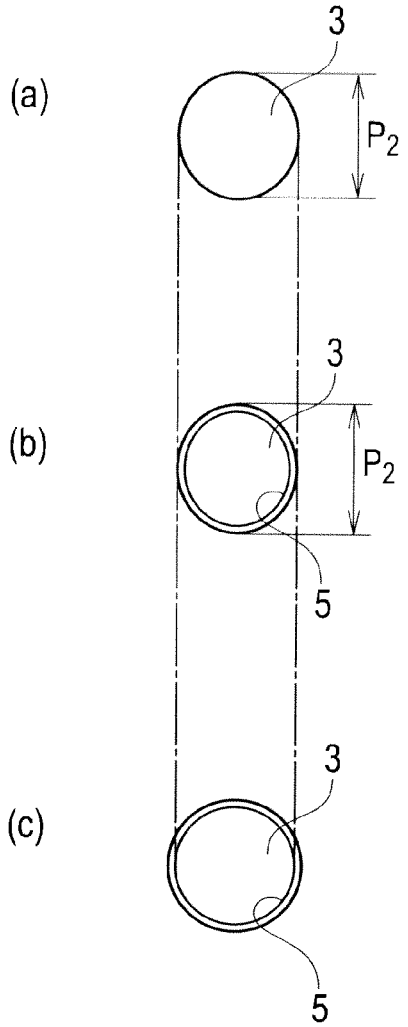
FIG. 5 is a diagram showing a change in the shape of the cylinder bore in accordance with the contents of work in FIG. 4.

After the machining in the work 21*a* in FIG. 4, the thermal spray coating 5 is formed on the inner surface of each cylinder bore 3 having the pre-deformation shape, by using a conventionally-known thermal spraying technique (work 21*b*). FIGS. 5(*a*) and 5(*b*) show the shape of the cylinder bore 3 subjected to the work 21*a* in FIG. 4 and the shape of the cylinder bore 3 subjected to the work 21*b* in FIG. 4, respectively. The dimension $P_2$ in FIGS. 5(*a*) and 5(*b*) corresponds to the length (longer diameter before deformation) $P_2$ of the cylinder bore 3 in FIGS. 7(*a*) and 7(*b*).

After the thermal spraying step 21 for forming the thermal spray coating 5, the preprocessing step 23 and the leak test 25 are sequentially performed.

In the bearing cap attachment step 27 after the leak test 25, the bearing cap 7 is attached to the cylinder block 1 having the cylinder bores 3 machined into the shapes shown in FIG. 7. An acting direction of a stress generated by the fastening of the bolts 9 for attachment of the bearing cap 7 is a direction corresponding to the length (longer diameter after deformation) $P_1$ in FIG. 2.

A direction along the length (longer diameter after deformation) $P_1$ in FIG. 2 corresponds to a direction along the length (shorter diameter before deformation) $Q_2$ in FIG. 7. For this reason, when the bolts 9 are fastened, the shape of the inner surface of each cylinder bore 3 in the section perpendicular to the axial direction of the cylinder bore 3 is deformed from the ellipse or oval in FIG. 7 into a true circle.

To be more specific, a long-side direction along the longer diameter $P_2$ of the ellipse or oval before the deformation in FIG. 7 and a long-side direction along the longer diameter $P_1$ of the ellipse or oval after the deformation in FIG. 2 are orthogonal to each other. For this reason, by the attachment of the bearing cap 7 to the cylinder block 1, the ellipse or oval in FIG. 7 is deformed and corrected into a true circle as shown in FIG. 5(*c*). In this way, the shape of the inner surface of each cylinder bore 3 is corrected into a true cylindrical shape.

In this embodiment, particularly, each cylinder bore 3 before deformation has an elliptical or oval shape in a section perpendicular to the axial direction of the cylinder bore 3, at least at an axial middle position of the cylinder bore 3 (at a middle point on an axial length L). For this reason, the stress generated when the bearing cap 7 is attached to the cylinder block 1 allows the entire inner surface of the cylinder bore to be corrected into a true cylindrical shape more surely.

The cylinder bore 3 before deformation may have such a shape that the shape of a section thereof perpendicular to the axial direction of the cylinder bore 3 varies depending on the position of the section on the axial direction. If the direction or degree of deformation of the inner surface of each cylinder bore 3 caused by the attachment of the bearing cap 7 to the cylinder block 1 varies depending on the axial position on the cylinder bore 3, the sectional shape of the cylinder bore 3 can be varied according to the distribution of the deformation direction or degree. Thereby, the shape of the inner surface of the cylinder bore 3 after the attachment of the bearing cap 7 to the cylinder block 1 can further be approximated to an ideal cylindrical shape.

In the finishing process step 29, a finishing process, honing, is performed on the thermal spray coating 5 on the inner surface of each cylinder bore 3 which has been corrected to the true cylindrical shape. The inner surface of the thermal spray coating 5 has, as shown in FIG. 5(*c*), a true cylindrical shape with a true circular section. Thus, machining for cylindricity correction is unnecessary in the honing of the thermal spray coating 5. This allows improvement in the work efficiency of the finishing process, and thereby suppression of degradation in the overall work performance.

Moreover, there is no need to use an undue amount of coating material for correcting the inner surface of the thermal spray coating into a true cylindrical shape, as in the case of performing a finishing process on the thermal spray coating on the inner surface of the cylinder bore deformed into an ellipse or oval shown in FIG. 2. Thus, the amount of coating material used can be reduced to lower the material cost, and also, the time it takes to form the thermal spray coating 5 can be shortened.

Note that the thermal spraying step 21 is set following the casting step 19 in the method for manufacturing the cylinder block 1 according to this embodiment. This is because setting the thermal spraying step 21 in a later step such as, for example, directly before the finishing process step 29 increases the loss which arises if casting failure is found. In other words, if a casting failure is found when performing the thermal spraying, the cylinder block 1 has to be discarded, wasting the costs spent for the processing required between the casting work and the thermal spraying work, such as the preprocessing step 23.

Further, setting the thermal spraying step 21 directly after the casting step 19 enables less line alteration for later manufacture steps, which contributes to a reduction in facility costs. Setting the thermal spraying step 21 in a later step such as, for example, followed by the finishing process step 29 generates a need for placing the thermal spraying step 21 in the middle of an existing line, and this increases the scale of line alteration.

For the reasons above, it is desirable that the thermal spraying step 21 be set next after the casing step 19.

Second Embodiment

After the bearing cap 7 is attached to the cylinder block 1 having the thermal spray coating 5 on the inner surface of each cylinder bore 3 in the bearing cap attachment step 27, a finishing process such as honing is performed on the thermal spray coating 5 in the finishing process step 29. In the second embodiment, as the finishing process, rough honing and finish honing are performed. In this embodiment, as shown in FIG. 8(*a*), the rough honing is performed with a rough-honing head 39, which is a rough-finishing tool, being fixed and rigidly connected by a connector 43 to a driving unit 41 which drives and rotates the rough-honing head 39.

As described earlier using FIG. 2, the shape of the inner surface of each cylinder bore 3 in a section perpendicular to the axial direction of the cylinder bore 3 tends to elongate in certain directions and to be deformed into, for example, an elliptical shape or oval shape when the bearing cap 7 is fastened and fixed to the cylinder block 1. Performing the rough honing in the finishing process step 29 with the rough-honing head 39 and the driving unit 41 being rigidly connected to each other makes it possible to efficiently correct the shape of the inner surface of the cylinder bore 3 deformed into, for example, an ellipse or oval to a circle. Thereby, the work efficiency in the finishing process can further be improved.

Figure 8:
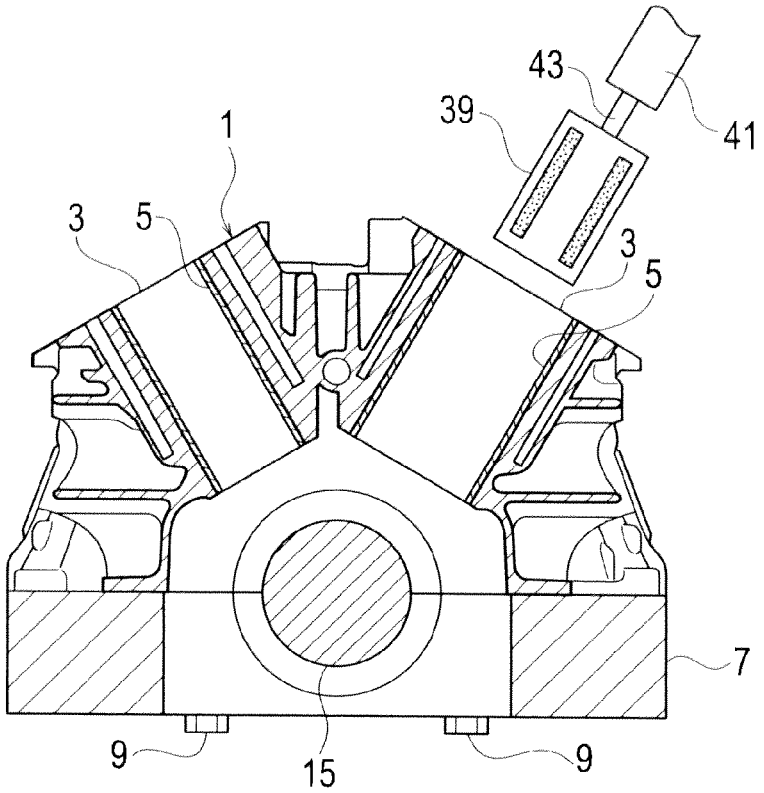
FIG. 8 is an explanatory diagram showing a finishing process performed on a thermal spray coating according to a second embodiment of the present invention.
Figure 8:
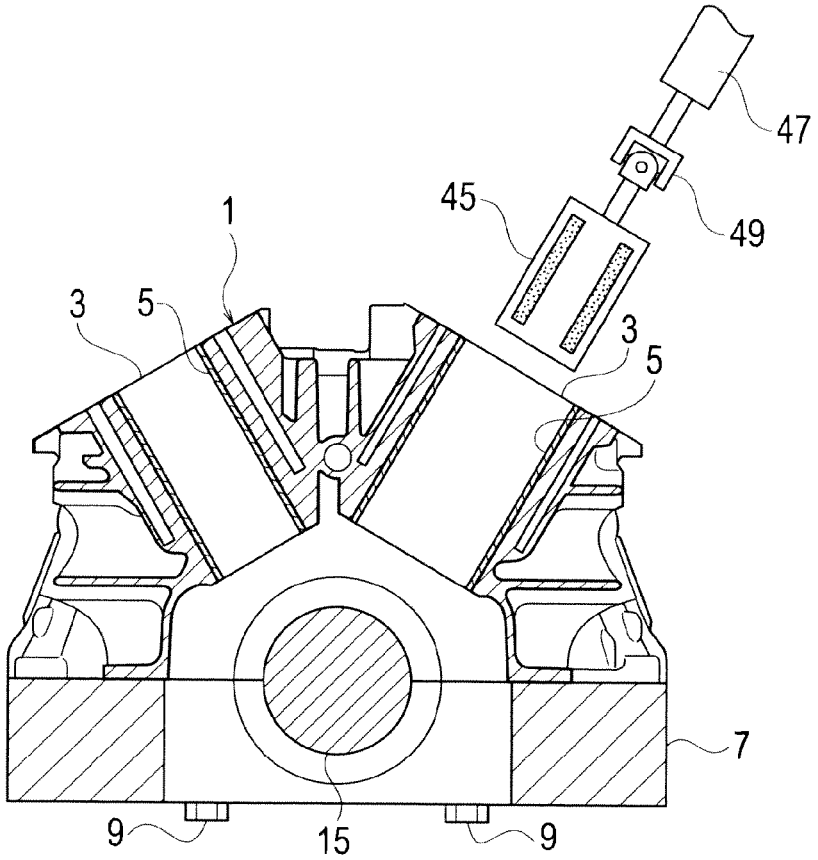

After the rough honing, the finish honing is performed in a floating state where a finish-honing head 45 is connected to a driving unit 47 via a universal joint 49, as shown in FIG. 8(*b*). Thereby, the thermal spray coating surface obtained by the rough honing can be finished efficiently with high precision.

Although the embodiments of the present invention are described above, these embodiments are mere examples described only to facilitate the understanding of the present invention, and the present invention is not limited to these embodiments. The technical scope of the present invention includes not only the specific technical matters disclosed in the above embodiments, but also various modifications, variations, alternative techniques, and the like that can be derived therefrom. For example, although the cylinder block 1 of the V-engine for automobile is described in the above embodiments, the present invention can also be applied to a cylinder block of a straight engine. Moreover, although the target shape of the inner shape of each cylinder bore 3 is a cylindrical shape satisfying required cylindricity in the example described above, the shape is not particularly limited, and may be a cylindrical shape whose section is an ellipse.

This application claims priority from Japanese Patent Application No. 2011-281331 filed on Dec. 22, 2011, the entire content of which is incorporated herein by reference.

INDUSTRIAL APPLICABILITY

According to the present invention, when a bearing cap is attached to a cylinder block, an inner surface of a thermal spray coating on a cylinder bore can be deformed into a true cylindrical shape satisfying required cylindricity. Since this makes a process for correcting the cylindricity unnecessary in a finishing process performed on the thermal spray coating thereafter, the work efficiency in the finishing process is improved.

REFERENCE SIGNS LIST

1 cylinder block
3 cylinder bore
5 thermal spray coating
7 bearing cap
39 rough-honing head (rough-finishing tool)
41 driving unit

The invention claimed is:

1. A manufacturing method for a cylinder block of a V engine comprising:

a casting step of casting a cylinder block of a V engine;

a thermal spraying step following the casting step;

an attachment step of attaching a bearing cap to the cylinder block after the thermal spraying step; and a finishing process step, after the attachment step, of performing a finishing process on a thermal spray coating formed on an inner surface of a cylinder bore having a target shape, the thermal spraying step comprising:

machining the inner surface of the cylinder bore into a first shape different from the target shape; and forming the thermal spray coating on the inner surface of the cylinder bore having the first shape.

2. The manufacturing method for a cylinder block of a V engine according to claim 1, further comprising:

performing a rough finishing process on the thermal spray coating by using a rough-finishing tool which is rigidly connected to and driven and rotated by a driving unit.

3. The manufacturing method for a cylinder block of a V engine according to claim 1, wherein the target shape is a cylindrical shape having a predetermined cylindricity, and the first shape is a shape having an elliptical or oval shape in a section thereof which is taken at a middle position of the cylinder bore in an axial direction thereof and perpendicular to the axial direction of the cylinder bore.

* * * * *